US005916414A

United States Patent [19]

Kato et al.

[11] Patent Number: 5,916,414

[45] Date of Patent: Jun. 29, 1999

[54] GLUE APPLICATOR FOR CORRUGATED BOARD

[75] Inventors: Toshihide Kato; Takayuki Miyake; Jun Watanabe, all of Mihara, Japan

[73] Assignee: Mitsubishi Heavy Industries, Ltd., Japan

[21] Appl. No.: 08/914,147

[22] Filed: Aug. 19, 1997

[30] Foreign Application Priority Data

Aug. 22, 1996 [JP] Japan ..... 8-220873
Feb. 24, 1997 [JP] Japan ..... 9-038833

[51] Int. Cl.[6] ..... B05C 1/08

[52] U.S. Cl. ..... 156/578; 118/62; 118/248; 156/470

[58] Field of Search ..... 156/210, 472, 156/578, 350, 470, 358; 118/248, 62

[56] References Cited

U.S. PATENT DOCUMENTS 4,351,264 9/1982 Flaum et al. .
4,617,076 10/1986 Jones, Jr. et al. .
4,764,236 8/1988 Nikkel .
5,129,980 7/1992 Sissons .

FOREIGN PATENT DOCUMENTS 6178632 4/1986 Japan .
818386 2/1996 Japan .

*Primary Examiner*—Richard Crispino
*Attorney, Agent, or Firm*—Rothwell, Figg, Ernst & Kurz, p.c.

[57] ABSTRACT

A presser shoe is disposed over the entire width of a single-faced corrugated board opposedly to a glue applicator roll with a traveling path of the single-faced corrugated board therebetween, and a flexible tube is provided which presses the presser shoe toward the single-faced corrugated board by air pressure. The air pressure to be fed to the flexible tube is regulated to a predetermined pressure by an air pressure regulator so as to afford a constant pressing force continually even in the use of single-faced corrugated boards of different flutes. The pressing shoe is formed with a longitudinally extending channel as an air flowing path at least on both longitudinal end sides thereof located outside the single-faced corrugated board, and air nozzles are formed in the presser shoe perpendicularly to the surface of the glue applicator roll over an area capable of being opposed to the single-faced corrugated board, whereby an air jet deviated from the board does not strike against the surface of the glue applicator roll directly.

4 Claims, 11 Drawing Sheets

GLUE APPLICATOR FOR CORRUGATED BOARD

BACKGROUND OF THE INVENTION

1. Field of the Invention

The present invention relates to a glue applicator which is mounted in a gluing machine just before a double facer in a corrugating machine and which is for the supply of glue to corrugation flute tips of a single-faced currugated board.

2. Description of the Related Art

A schematic construction of a gluing machine portion mounted in a corrugating machine will now be described with reference to FIG. 8. A conventional glue applicator mounted to a gluing machine 1 in a corrugating machine comprises a glue supply portion 5 and a rider roll 6. The glue supply portion 5 comprises a glue applicator roll 2, a doctor roll 3 and a glue reservoir 4 located below the glue applicator roll 2. The rider roll 6 is opposed to the glue applicator roll 2 through a predetermined clearance. By the glue applicator, glue 9 is transferred and supplied to flute tips of a core board 8 of a single-faced corrugated board 7 which travels between the glue applicator roll 2 and the rider roll 6.

On the board inlet side of the glue applicator roll 2 is disposed a presser roll 10, while on the board discharge side of the roll 2 is disposed a tension roll 11. By means of the presser roll 10 and tension roll 11 the traveling of the single-faced corrugated board 7 is kept stable and the length of contact of the glue 9 with the board 7 is kept constant.

The single-faced corrugated board 7 fabricated by a single facer in the preceding step is entrained on a guide roll 12 and then on a preheat roll 13, whereby it is heated to a moderate extent. Thereafter, the board 7 thus heated is fed to the gluing machine 1 and comes into contact with the glue applicator roll 2 while traveling between the roll 2 and the rider roll 6, whereby the glue 9 present on the outer peripheral surface of the roll 2 is transferred and fed to the flute tips of the core board 8.

After a part of the peripheral surface of the glue applicator roll 2 is dipped in the glue reservoir 4, the amount (thickness) of glue on the outer peripheral surface of the roll 2 is controlled by the doctor roll 3 disposed adjacent the roll 2 and a long the arrowed rotational path in the figure. The surplus glue scraped off by the doctor roll 3 drops into the glue reservoir 4 and is thus recovered. The single-faced corrugated board 7 which has passed the gluing machine 1 is then fed to a heating portion 15 of a double facer 14 in the next step. In the heating portion 15, the board 7 joins a liner 16 which has been fed through another route, and both are laminated together to form a double-faced corrugated board 17.

As to the double-faced corrugated board 17, various such boards can be fabricated according to purposes of use. FIG. 8 shows an example in which two single-faced corrugated boards 7, namely a single-faced corrugated board 7*a* with glue 9 applied thereto by the upper glue applicator in the same figure, and a single-faced corrugated board 7*b* with glue 9, applied thereto by the lower glue applicator in the same figure, and the liner 16 are laminated together to form the double-faced corrugated board 17.

In each glue applicator, the rider roll 6 is disposed in an opposed relation to the glue applicator roll 2, to press the single-faced corrugated board 7 against the roll 2. The state of engagement (clearance and nipping pressure) between the glue applicator roll 2 and the rider roll 6 is an important factor which influences the quality (strength) of the double-faced corrugated board 17. For example, it is known that if the flute tips of the core board 8 are crushed, the strength of the corrugated board case using the core board 8 is deteriorated rapidly. In view of this point the rider roll 6 is supported so as to permit adjustment of its state of engagement relative to the glue applicator roll 2.

Now, with reference to FIG. 9, a description will be given of a support structure for the rider roll 6 which structure has heretofore been adopted. In the example shown in FIG. 9, the rider roll 6 is journaled at both axial ends thereof to a pair of swing brackets (arms for the rider roll) 20. The swing brackets 20 are adapted to move pivotally about a pivot shaft 18 with expansion and retraction of a cylinder 19, relative to the glue applicator roll 2, which is positioned fixedly. Eccentric rolls 21 are respectively engaged with the swing brackets 20 located at both transverse ends of the device. Vertical swing position of the swing brackets 20 can be adjusted by setting the phase angle of the eccentric rolls 21 appropriately. By so adjusting the vertical swing position of the swing brackets 20, it is possible to appropriately set the clearance between the outer peripheral surface of the rider roll 6, each journaled to a portion of the associated swing bracket 20, and the outer peripheral surface of the glue applicator roll 2.

On the other hand, as means for pressing the single-faced corrugated board 7 against the glue applicator roll 2, there has been proposed such a device as shown in FIG. 10 (described in Japanese Patent Publication No. 18386/96). According to this proposed device, a beam 22 is mounted in the axial direction of the glue applicator roll 2, a plurality of brackets 23 are attached side-by-side to the beam 22, and a plate-like shoe 25, which is adapted to move pivotally about a pin 24, is secured to the lower end of each bracket 23. A compression spring 26 is engaged with the plate-like shoe 25 on the swing end side of the shoe, while on the rear end side of the shoe 25 is provided a positioning bolt 27. The swing motion of the shoe 25 toward the glue applicator roll 2 side is restricted by the positioning bolt 27, and hence a pressing force, which permits the formation of a predetermined clearance, can be applied by the compression spring 26. The shoe 25 is arranged in a plurally divided form in the transverse direction of the single-faced corrugated board 7, so that each shoe can swing independently. Therefore, in the event of partial wear or breakage, only the part concerned need be replaced with a new one.

The single-faced corrugated board 7 is pressed against the glue applicator roll 2 by means of the rider roll 6 and the shoes 25, whereby the nipping pressure for the board 7 can be maintained at an optimum level, and hence the quality (strength) of the double-faced corrugated board 17 is kept high.

The rider roll 6 shown in FIG. 9 is for setting, in a fixed position manner, a predetermined clearance required according to the thickness of the single-faced corrugated board 7 and the type of flute. Therefore, in the case where two or more types of single-faced corrugated boards 7 differing in flutes are to be used in the same unit, it has so far been necessary to set the clearance for each type of board. Moreover, there occurs a variation in the contact pressure, due to a difference in flute tip height, which is caused by different kinds (thicknesses) of paper, or different production conditions, thus requiring a high degree of skill for clearance adjustment. Further, even in the same flute of paper, a slight difference in thickness of the single-faced corrugated board 7 can occur, according to flute handling conditions in the single facer. An initial clearance between the rider roll 6 and the glue applicator roll 2 is usually set at a value corresponding to the minimum flute height, taking variations in chevron-shaped flute height into account. With high flute tips, therefore, the amount of collapse increases, thus resulting in application of extra glue 9 to the flute tips and consequent increase in the amount of glue consumed.

In the device using the shoes 25 shown in FIG. 10, since each shoe 25 is vertically movable independently, a certain width of the single-faced corrugated board 7 permits engagement of a shoe 25 with a slight pressure width, h, at a board end, thus causing an increase of the pressing force per unit area, and consequent collapse and droop of the board end, as shown in FIG. 11(*a*). In the event the single-faced corrugated board 7 meanders and deviates from a shoe 25, as shown in FIG. 11(*b*), the leftmost end shoe 25*a*, in the same figure, drops lower than the surface of the board 7. Consequently, when the board 7 tries to return to the original traveling position, a side face 25*b* of the shifted shoe 25*a*, and a side end face 7*c* of the board 7, interfere with each other, with the likelihood of occurrence of a trouble such as flaw or damage to the side end of the board 7.

In the device using the shoes 25, moreover, since the difference in the kind (thickness) of paper or in the flute tip height causes a change in the amount of deflection of the compression spring 26, there occur variations in the pressing force applied to the shoes 25. Besides, it is impossible to change the pressing force according to flutes or according to the state (twist or corrugation) of the single-faced corrugated board 7. Further, in adjusting the pressing force for the single-faced corrugated board 7, it is necessary to stop the operation of the machine from the standpoint of safety. Since the single-faced corrugated board tends to warp, there also arises the problem that a uniform pressure is not always obtained even if the clearance alone is kept strictly in parallel. In connection with this pressing method, various improvements have so far been tried.

FIG. 12 shows an example of such pressing method, which is described in Japanese Patent Laid Open No. 78632/86. According to the illustrated method, an air pressure, which is fed through an orifice 72 from a manifold 70, and a presser shoe 71 fixed therebelow, is used to press a single-faced corrugated board against a glue applicator roll 2.

FIG. 13 shows another example, which is described in U.S. Pat. No. 4,764,236. In this example, presser shoes 75, divided in a large number, are provided longitudinally, and air is jetted from holes 76 formed therein, to press a single-faced corrugated board 7 against a glue applicator roll 2. In this case, the pressing force is buffered by means of a plate spring 77 and a coiled spring 78.

In the case where the pressing force is induced by an air pressure through the presser shoes, the clearance between the pressing shoes and the single-faced corrugated board, that is, the thickness of the air layer, is very important, and a change thereof would cause a change in the pressing force. Accordingly, a change in flute of the single-faced corrugated board, or a great change in the kind (thickness) of paper, also causes a change in the pressing force.

Since the presser shoes 75 shown in FIG. 13 are minutely divided in the transverse direction of the single-faced corrugated board, substantially the same drawbacks as in FIG. 10 are encountered. On the other hand, the presser shoe 71 shown in FIG. 12 is integral in the transverse direction, and is formed to permit a fluid jet. However, its rigid structure is disadvantageous, in that a uniform pressing force is not obtained against a non-uniform thickness in the width direction of the single-faced corrugated board.

In all of the above-described devices using a pneumatic pressure or an air film to diminish the frictional force, air is jetted from nozzles, which are directed toward the liner of the single-faced corrugated board being conveyed.

Usually in the production of corrugated boards, various widths of papers are used, ranging from the maximum width of the machine used, to about a half thereof.

Since nozzles are arranged usually over the maximum machine width, if a narrower paper is used, it follows that there is no paper at both end portions. Consequently, the air jetted from the nozzles located at both ends is directed directly to the surface of the glue applicator roll.

When air strikes against the surface of the glue applicator roll at high speed, it causes the glue to scatter, with the result that, not only the surroundings of the machine are stained, but also the glue is deposited on a paper pressing bar, etc., and becomes solidified after a long-time operation, thus making it difficult to obtain a uniform pressing force when a wider paper is then fed.

SUMMARY OF THE INVENTION

It is the first object of the present invention to provide a glue applicator for a corrugated board, capable of facilitating an engaged state at a uniform pressure, irrespective of the type of flute or variations in flute tip height, and further capable of diminishing the frictional resistance of a presser shoe, and thereby improving the frictional resistance.

It is the second object of the present invention to provide a glue applicator for a corrugated board, capable of preventing or reducing the scatter of glue, and thereby preventing or reducing the stain of the machine used and deterioration in quality of the board.

In order to achieve the above-mentioned objects, in the first aspect of the present invention there is provided a glue applicator for a corrugated board, the glue applicator including a presser shoe disposed over the entire width of the corrugated board, in an opposed relation to a glue applicator roll, with a corrugated board traveling path therebetween; a flexible tube which presses the presser shoe to the corrugated boardside by virtue of a fluid pressure; and a controller which adjusts the fluid pressure to be fed to the flexible tube to a predetermined pressure, and thereby controls the pressing force of the presser shoe against the corrugated board.

In the second aspect of the present invention there is provided, in combination with the glue applicator in the first aspect, a glue applicator for a corrugated board further including a fluid jet arrangement for jetting a fluid from hole members, the hole members being formed transversely in the presser shoe on the side opposed to the corrugated board.

In the third aspect of the present invention there is provided, in combination with the glue applicator in the second aspect, a glue applicator for a corrugated board, wherein the presser shoe is formed with a longitudinally extending channel as a fluid flowing path, at least on both longitudinal end sides thereof located outside the corrugated board, and no fluid nozzle that faces the surface of the glue applicator roll is present on the said longitudinal end sides.

In the fourth aspect of the present invention there is provided, in combination with any of the above glue applicators, a glue applicator for a corrugated board wherein the fluid is air.

BRIEF DESCRIPTION OF THE DRAWINGS

The present invention will become more fully understood from the following detailed description in conjunction with the accompanying drawings which are given for the purpose of illustration only and thus are not limitative and wherein:

FIG. 6(B) is a view taken on line VI—VI in FIG. 5;

DETAILED DESCRIPTION OF THE PREFERRED EMBODIMENTS

Figure 1:
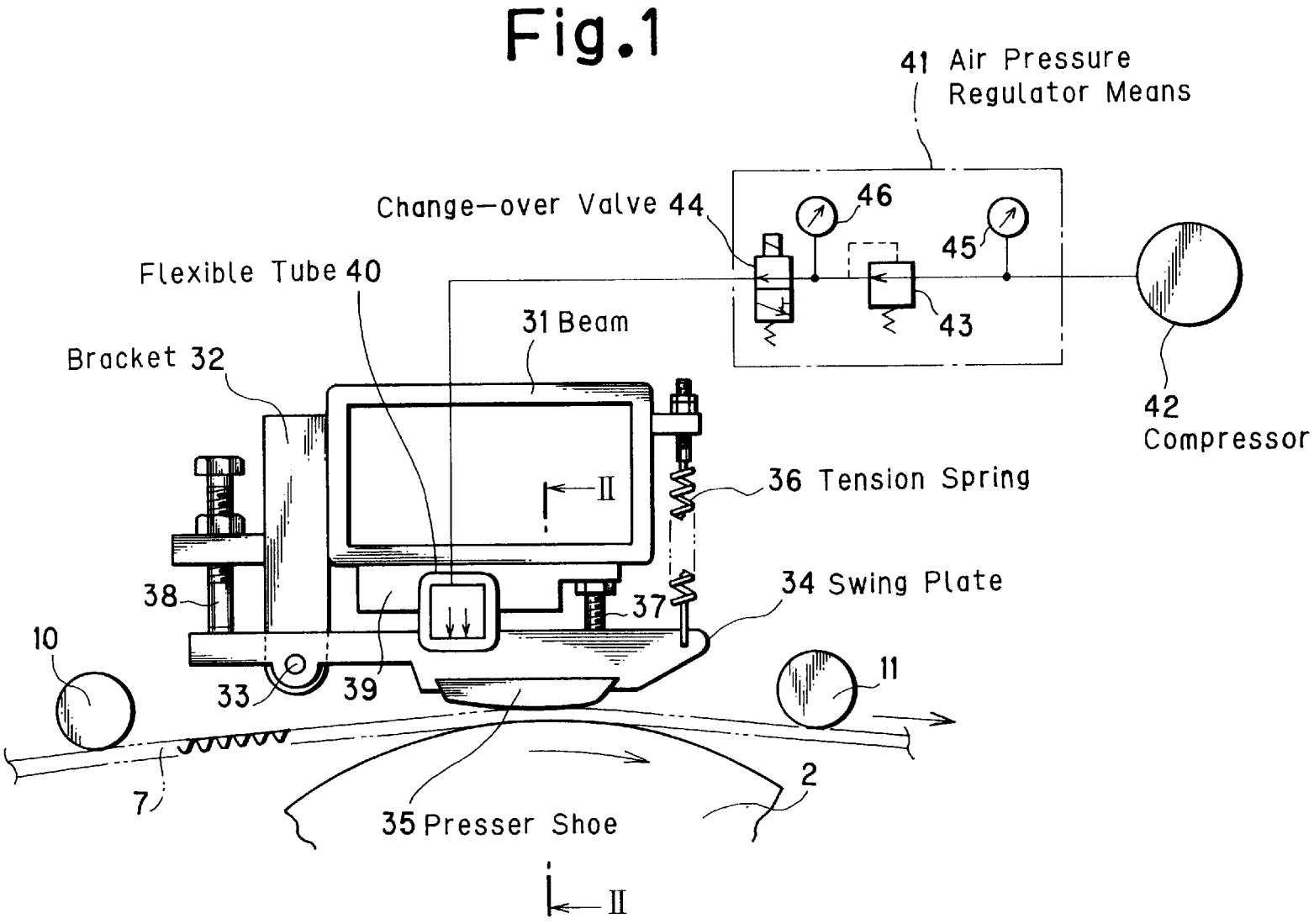
FIG. 1 is a sectional view of principal portions of a glue applicator for a corrugated board according to a first embodiment of the present invention.
Figure 2:
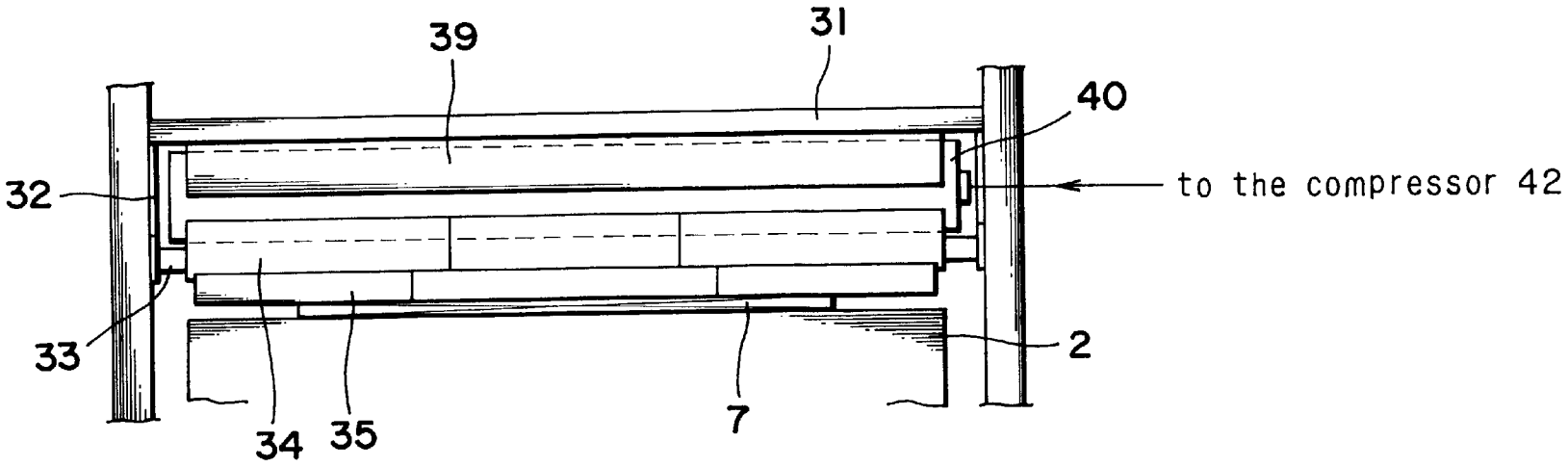
FIG. 2 is a view taken on line II—II in FIG. 1.

FIG. 1 is a side view of principal portions of a glue applicator for a corrugated board according to the first embodiment of the present invention, and FIG. 2 is a view taken on line II—II in FIG. 1. The glue applicator of this embodiment is disposed in an opposed relation to the glue applicator roll 2 in the gluing machine 1 shown in FIG. 8. Therefore, the same portions as in FIG. 8 are indicated by the same reference numerals as in FIG. 8, and detailed explanations thereof will be omitted.

Figure 8:
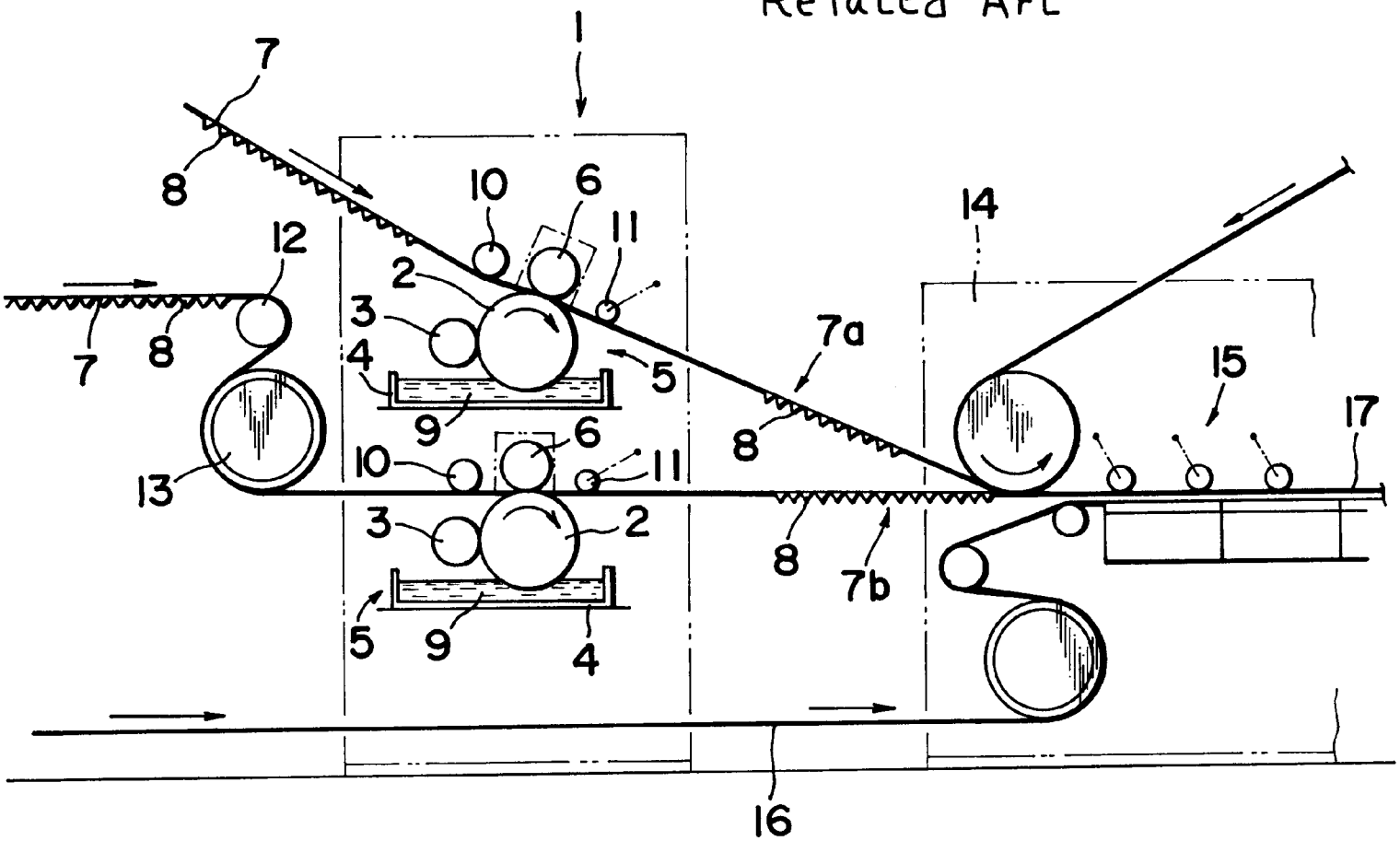
Fig.8 Related Art
FIG. 8 is a schematic construction diagram of a related gluing machine portion mounted in a corrugating machine.

As shown in FIG. 8, glue 9 is applied by the gluing machine 1 to the flute tips of the single-faced corrugated board 7 fabricated by the single facer in the preceding step, then the thus-glued board 7, and the liner 16 which has been fed through another route, are joined and fed to the double facer 14 in the next step. In the double facer 14, both are laminated and conveyed under the application of predetermined heat and pressure, to form a double-faced corrugated board 17.

The glue applicator is composed of a glue supply portion comprising the glue applicator roll 2, doctor roll 3 and glue reservoir 4, and a pressing portion for the single-faced corrugated board 7. As shown in FIG. 1, the pressing portion for the single-faced corrugated board 7 is located face-to-face with the glue applicator roll 2, through the board 7.

A beam 31 is mounted in the axial direction of the glue applicator roll 2, and a bracket 32 is fixed to the beam 31. To the lower end of the bracket 32 is connected a swing plate 34 pivotably through a pin 33, and a presser shoe 35 is secured to the underside of the swing plate 34. A front end (swing end) of the swing plate 34 is urged upward, and supported by means of a tension spring 36. A swing end on an upper swing side (counterclockwise in FIG. 1) of the swing plate 34 is restricted in its swing motion by means of an upper-limit stopper 37, while a swing end on a lower swing side (clockwise in FIG. 1) of the swing plate 34 is restricted in its swing motion by means of a lower-limit stopper 38.

On the other hand, a holder 39 is fixed to the underside of the beam 31, and a flexible tube 40, which extends longitudinally, is provided between the holder 39 and the swing plate 34. The flexible tube 40 is connected to a compressor 42, through air pressure regulator 41, serving as a controller, whereby air of a predetermined pressure is supplied to the flexible tube 40. The pressing force of the presser shoe 35 against the single-faced corrugated board 7 is controlled by regulating the air pressure to be fed to the flexible tube 40, with use of the air pressure regulator 41.

The air pressure regulator 41 is provided with a pressure reducing valve for reducing the pressure of compressed air supplied from the compressor 42 to a predetermined level, and a change-over valve 44, for turning on and off the supply of air from the pressure reducing valve 43 to the flexible tube 40. The pressing force of the presser shoe 35 is controlled by on-off operation of the change-over valve 44. Numerals 45 and 46 in the figure denote pressure gauges.

The swing plate 34, and the presser shoe 35, are each fabricated in a divided form, plurally in the transverse direction of the single-faced corrugated board 7. As shown in FIG. 2, both are joined together at a position which does not engage the opposite transverse ends of the board 7, and are rendered integral with each other, so as not to cause a difference in height at the joined portion during assembly. The swing plate 34, and the presser 35, may be formed integrally using a single member, without division.

The operation of the glue applicator constructed as above will now be described. Initially, the tension of the tension spring 36 is set at a slightly stronger tension, relative to a turning moment, based on the weight of both swing plate 34 and presser shoe 35, allowing the upper surface of the swing plate 34 to come into light abutment with the upper-limit stopper 37. The lower-limit stopper 38 is adjusted in such a manner that the underside of the presser shoe 35 is not brought into contact with the outer peripheral surface of the glue applicator roll 2, by the internal pressure of the flexible tube 40.

In such initialized conditions, the single-faced corrugated board 7 is fed, and then air of a predetermined pressure is fed, into the flexible tube 40, by operation of the change-over valve 44. More specifically, the supply and discharge of air, with respect to the flexible tube 40, are performed by on-off operation of the change-over valve 44, and visually, or with the aid of pressure gauges 45 and 46, the clearance between the glue applicator roll 2, and the presser shoe 35, is held in a predetermined state, according to the state of the single-faced corrugated board 7, for example.

In this way, a constant pressing force can be applied continually to the single-faced corrugated board 7, which travels synchronously with the peripheral speed of the glue applicator roll 2.

Therefore, even in the case where two or more kinds of single-faced corrugated boards 7 of different flutes are fed in the same unit, the clearance between the glue applicator roll 2, and the presser shoe 35, can be maintained in a predetermined state, by operation of the change-over valve 44 from the exterior. Thus, it is not necessary to adjust the roll-shoe clearance at every change from one flute to another flute of board 7, and a constant pressure is facilitated, irrespective of the kind of paper and the difference in flute tip height. Accordingly, even if single-faced corrugated boards 7 of different flutes are fed, there is no fear of flute collapse or the collapse of board edges. Thus, the amount of glue 9 supplied becomes stable and the amount of glue wasted can be greatly decreased. Further, by operating the change-over valve 44 to increase or decrease the internal pressure of the flexible tube 40, it becomes possible to set the pressing state delicately according to the state (twist or corrugation) of the single-faced corrugated board 7.

Figure 3:
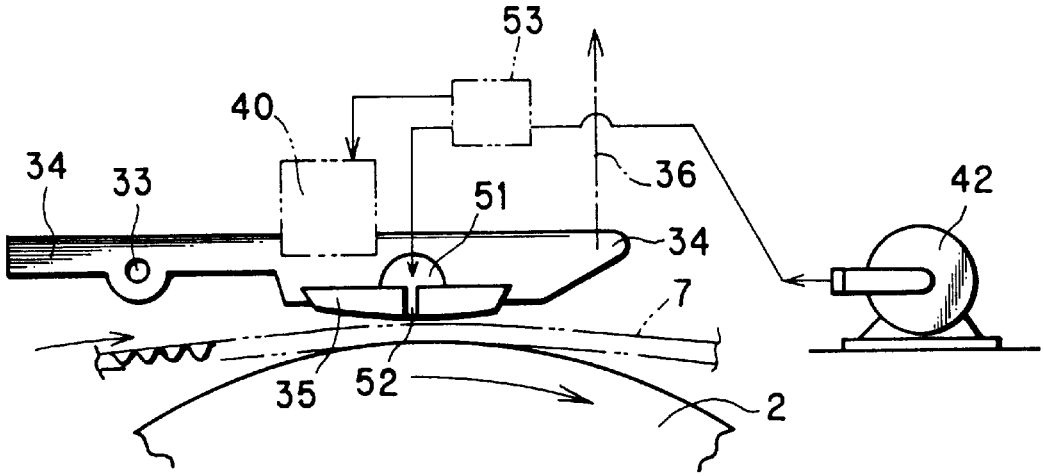
FIG. 3 is a schematic construction diagram showing a presser shoe used in a second embodiment of the present invention.

The second embodiment of the present invention will be described below, with reference to FIGS. 3 and 4. FIG. 3 illustrates a schematic construction of a presser shoe, and FIG. 4 illustrates a circuit configuration of air pressure regulating means.

As shown in FIG. 3, an air chamber 51 is formed longitudinally between a swing plate 34 and a presser shoe 35, and along the joined surface of the two, while in the presser shoe 35, are formed a plurality of air nozzles 52 as hole members, which are arranged in the longitudinal direction and correspondingly to the air chamber 51. The hole members can be form a longitudinally extending slits in the lower surface of the presser shoe 35. The air chamber 51 is connected to a compressor 42 through air pressure regulator 53 serving as a controller, whereby air of a predetermined pressure is fed to the air chamber 51 and is jetted from the air nozzles 52. The air pressure regulator 53 supplies air of a predetermined pressure also to a flexible tube 40.

Figure 4:
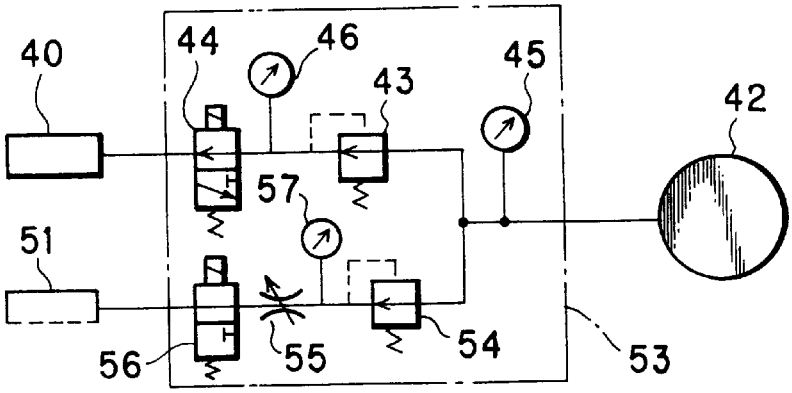
FIG. 4 is a circuit configuration diagram of air pressure adjusting means.

As shown in FIG. 4, the air pressure regulator 53 is provided with a pressure reducing valve 43 and a change-over valve 44 which are connected to the flexible tube 40. The air pressure regulator 53 is further provided with a pressure reducing valve 54, a flow control valve 55 and a change-over valve 56. Air of a predetermined pressure is fed to the air chamber 51 by on-off operation of the change-over valve 56. Numeral 57 in the figure denotes a pressure gauge.

In the glue applicator provided with the presser shoe 35 of the above construction, the single-faced corrugated board 7 is passed between the presser shoe 35 and the glue applicator roll 2, and air of a predetermined pressure is fed to the air chamber 51 by operation of the change-over valve 56. The air thus fed to the air chamber 51 is jetted toward the board 7 from the air nozzles 52 formed in the lower surface of the presser shoe 35. As a result, an air layer is formed between the surface of the board 7 and the presser shoe 35, whereby the frictional resistance and wear of the sliding surface of the shoe 35 can be greatly diminished.

In the above glue applicator for a corrugated board, even if a corrugated board 7 of a different flute is fed, there is no fear of flute collapse or the collapse of board edges. Consequently, the amount of glue 9 fed becomes stable and the amount of glue wasted can be greatly decreased. Besides, by operating the change-over valve 44 to increase or decrease the internal pressure of the flexible tube 44, it is made possible to set the pressing state delicately according to the state (twist or corrugation) of the single-faced corrugated board 7. Moreover, since an air layer can be formed between the surface of the single-faced corrugated board 7 and the presser shoe 35, it is possible to greatly reduce the frictional resistance and wear of the presser shoe 35.

Figure 9:
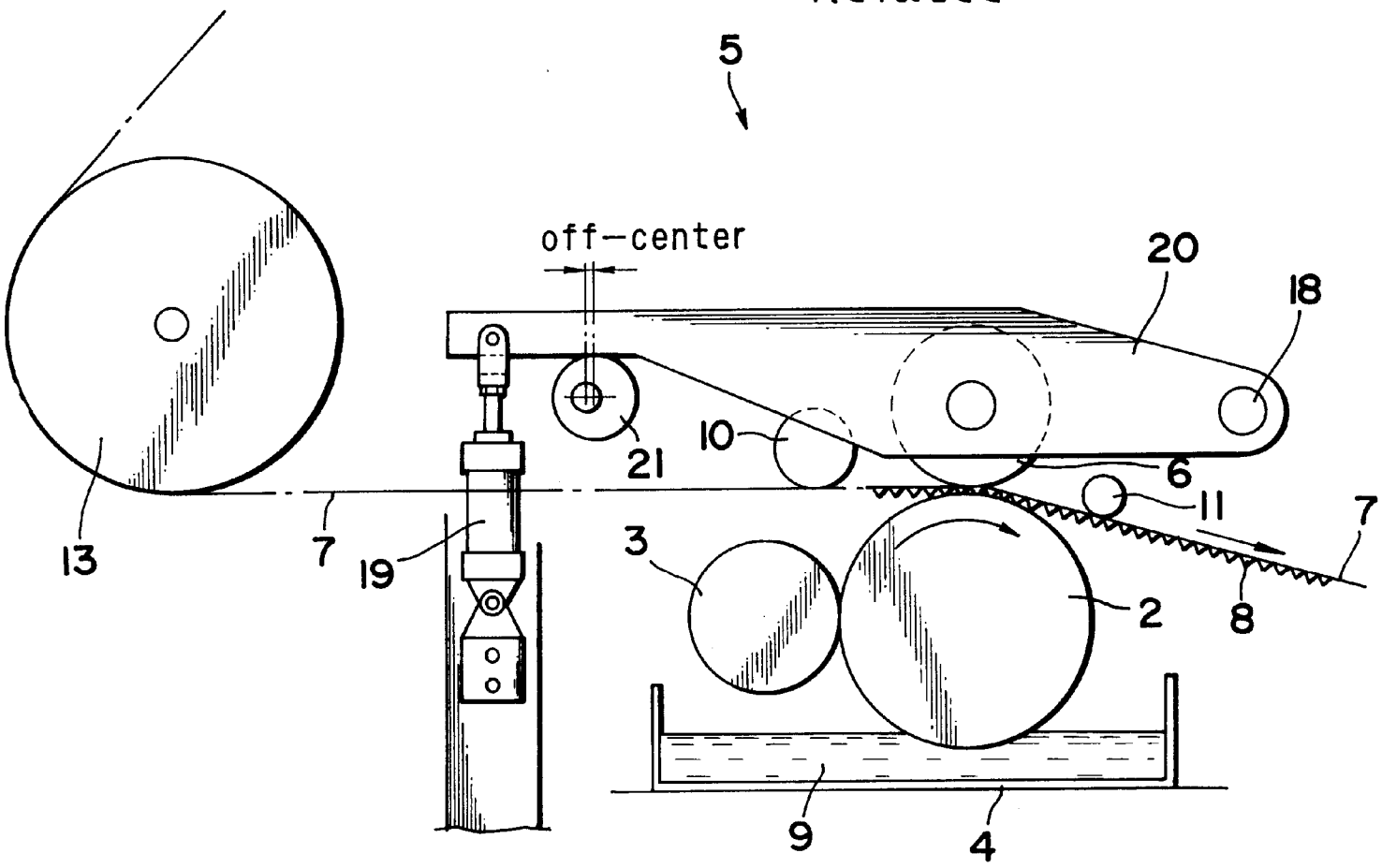
Fig. 9 Related Art
FIG. 9 is an enlarged view of principal portions in FIG. 8.
Figure 10:
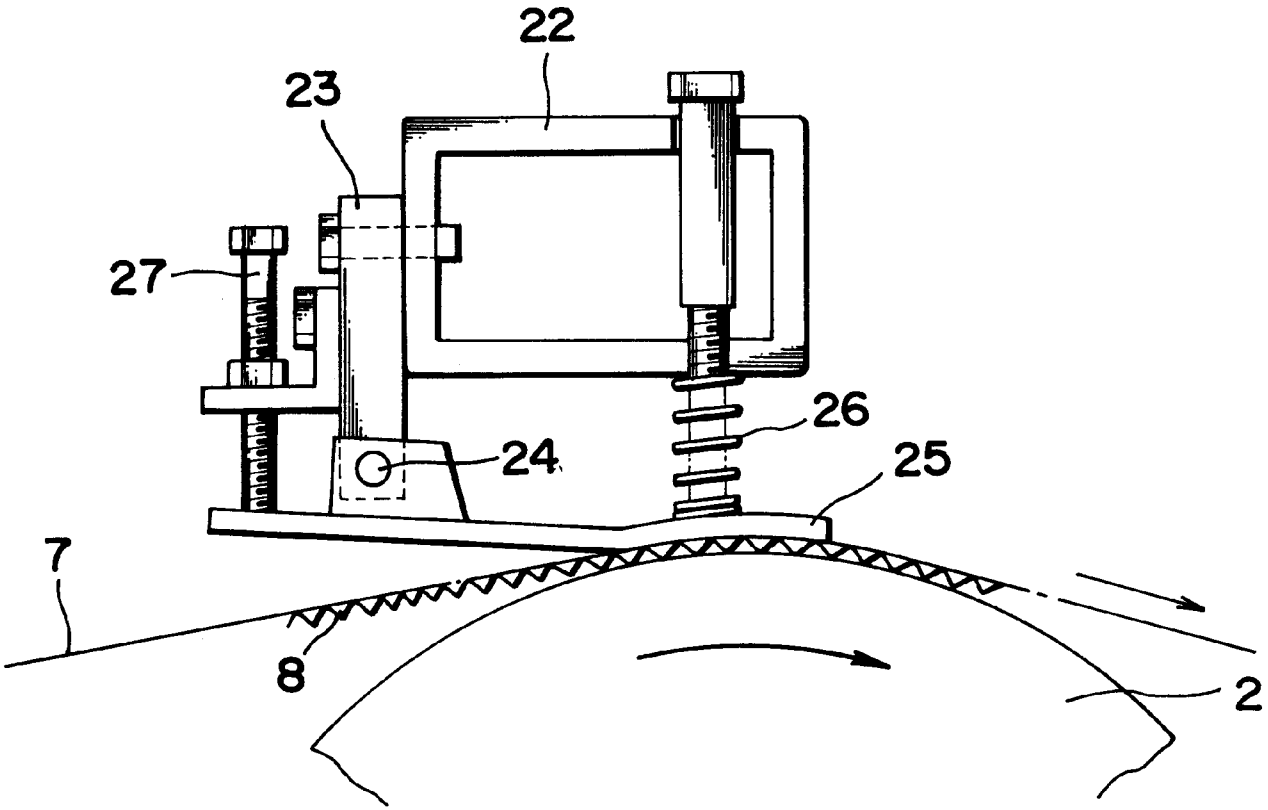
Fig. 10 Related Art
FIG. 10 is an explanatory view of a conventional presser shoe supporting condition.
Figure 11A:
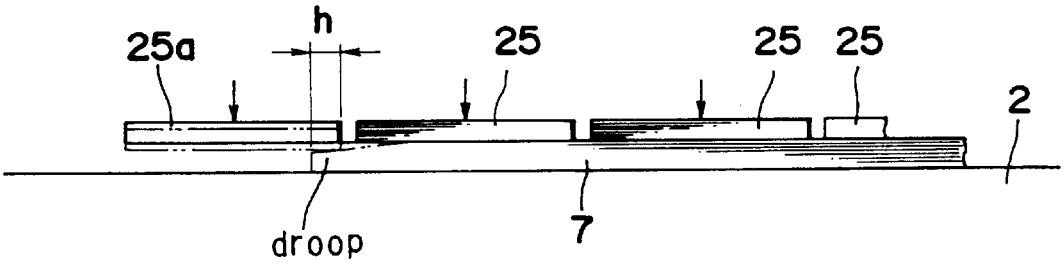
Fig.11(A) Related Art
FIGS. 11(A)–(C) are explanatory views of a pressing condition using a conventional presser shoe.
Figure 11B:
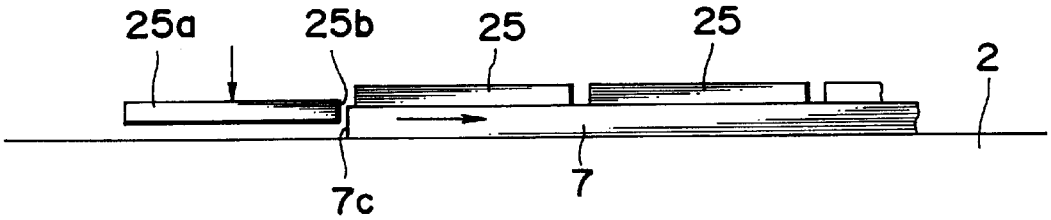
Fig.11(B) Related Art
Figure 11C:
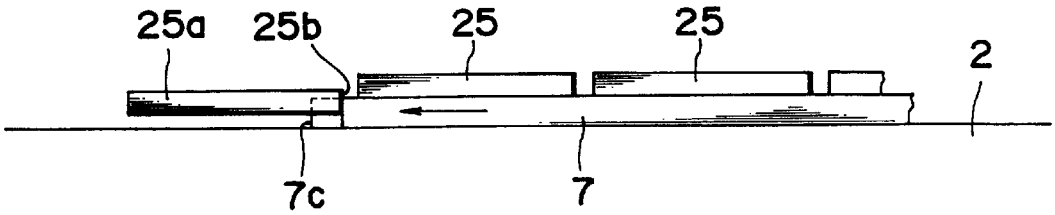
Fig.11(C) Related Art
Figure 12:
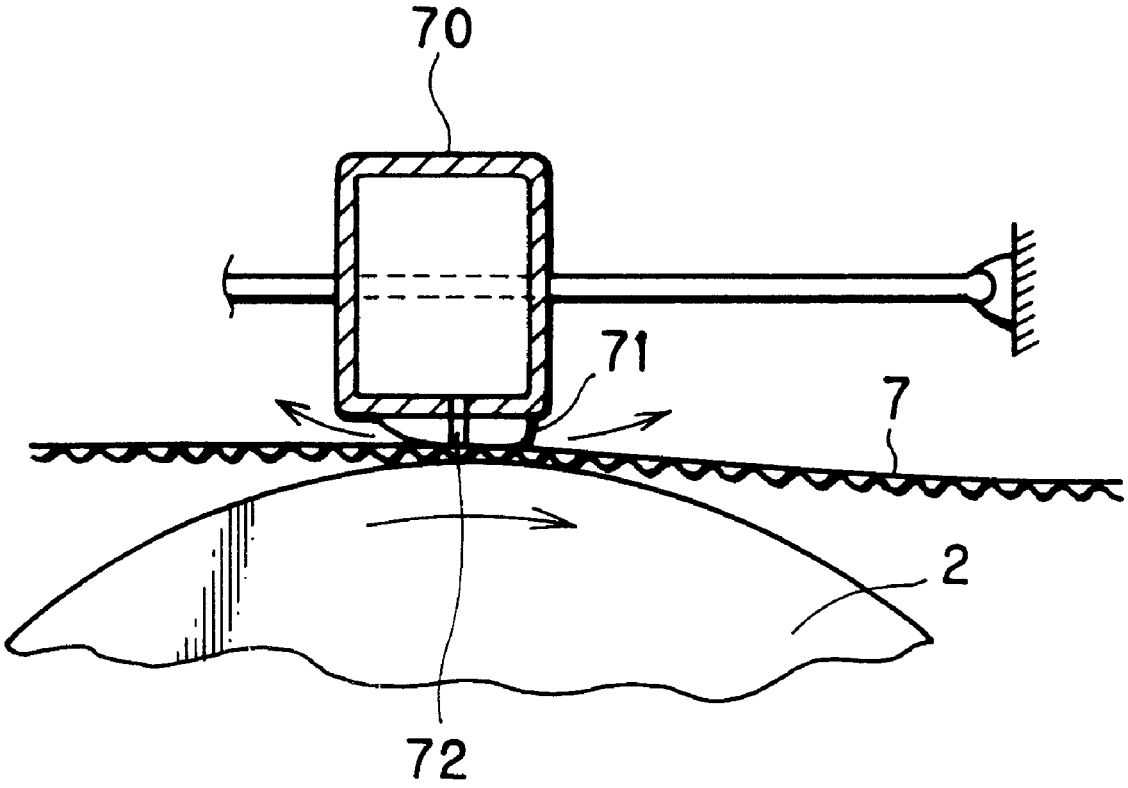
Fig.12 Related Art
FIG. 12 is an explanatory view showing another presser shoe supporting condition according to the related art.
Figure 13:
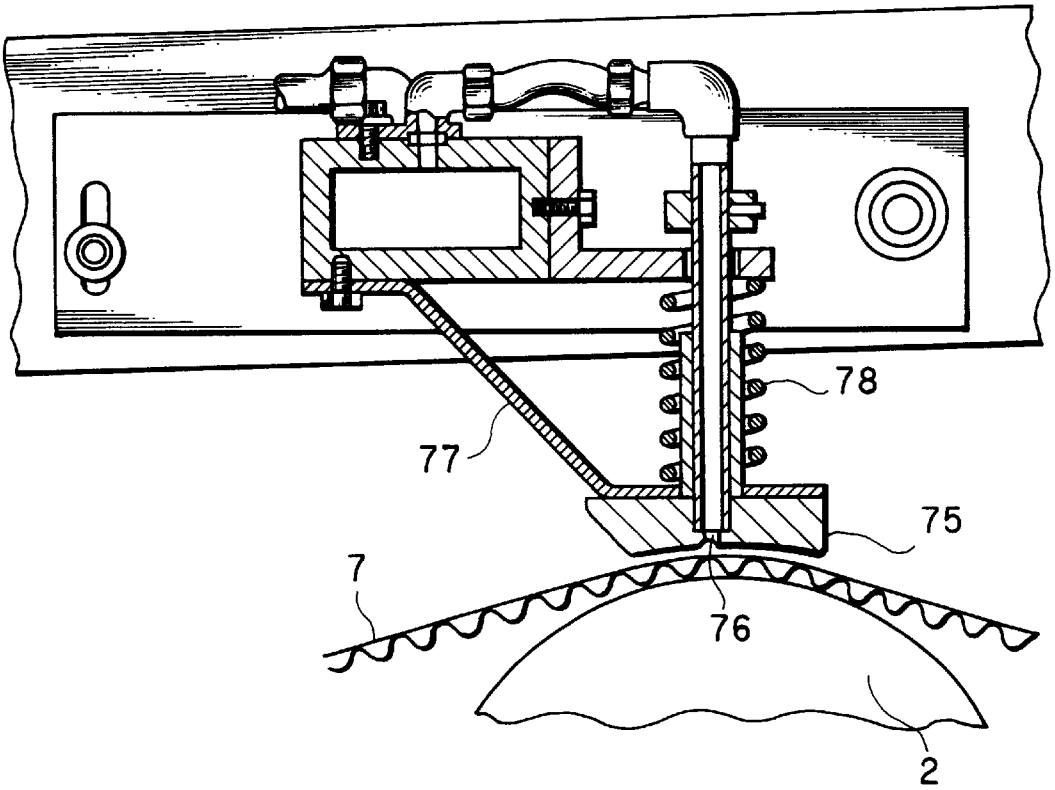
Fig.13 Related Art
FIG. 13 is an explanatory view of a pressing condition using a conventional presser shoe.

Further, by mounting the presser shoe 35 in apre-assembled state to the existing brackets 20 (see FIG. 9), the glue applicator of this embodiment can be applied to a conventional machine and thus reconstruction can be effected less expensively. Additionally, the presser shoe 35 can be moved pivotally upward by reducing the pressure of the air fed to the flexible tube 40, whereby there can be formed a wide clearance between the presser shoe and the glue applicator roll 2. Consequently, the working efficiency in the initial threading is greatly improved.

The presser shoe 35 can be formed using any of various materials. For example, it can be fabricated by applying hard chromium plating to the surface of a steel shoe, or it may be formed using resin. The shape of the lower surface (sliding surface) of the presser shoe 35 is not limited to the illustrated convex shape. For example, it may be formed in a concave shape along the curved surface of the single faced corrugated board 7 and at a slightly larger radius of curvature. Further, the hole members formed in the presser shoe 35 may be plural rows of air nozzles or plural slits.

Figure 5:
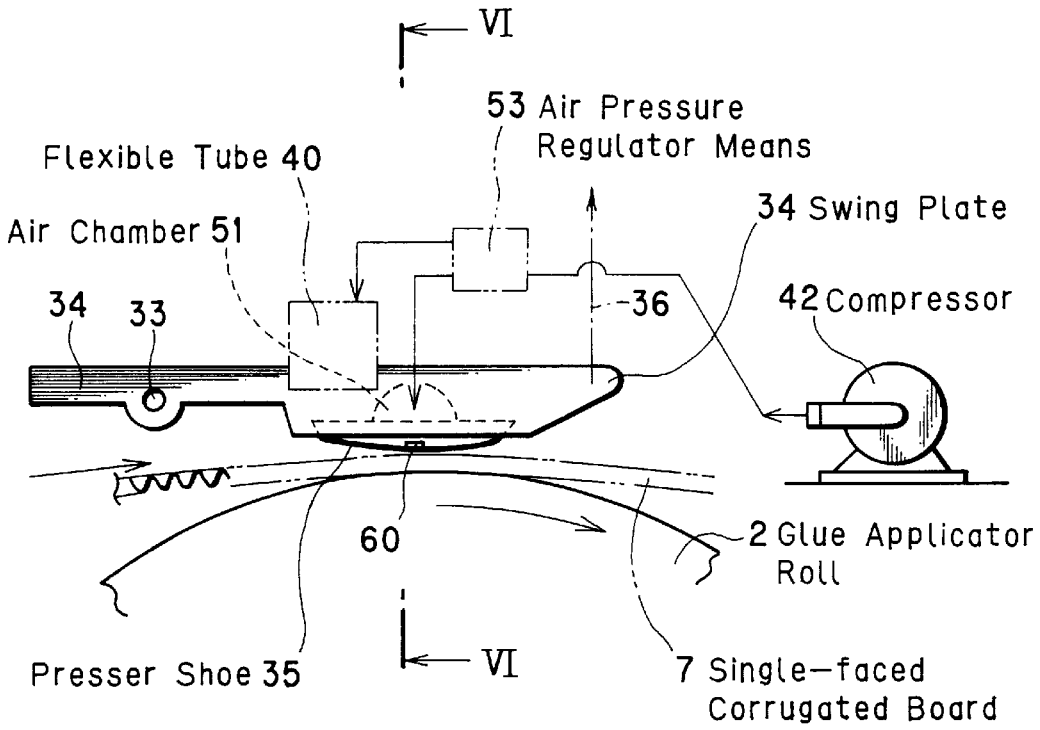
FIG. 5 is a side view of principal portions of a glue applicator for a corrugated board according to a third embodiment of the present invention.

The third embodiment of the present invention will be described below with reference to FIGS. 5 and 6. FIG. 5 is a side view of principal portions of a glue applicator for a corrugated board according to the third embodiment of the present invention, and FIG. 6 is a sectional view taken on line VI—VI in FIG. 5.

As shown in FIG. 5, a presser shoe 35 is attached to the lower surface of a swing plate 34. A front end (swing end) of the swing plate 34 is urged upward and supported by a tension spring 36.

On the other hand, a flexible tube 40 is provided longitudinally between a holder (see FIG. 1) on the underside of a beam (not shown) and the swing plate 34. The flexible tube 40 is connected to a compressor 42 through air pressure regulating means 53 serving as a controller, whereby air of a predetermined pressure is fed to the flexible tube 40.

Figures 6A, 6B:
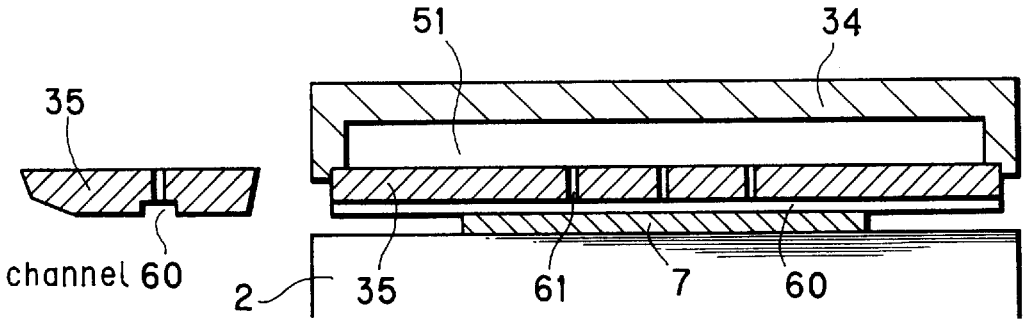
FIGS. 6(A) and 6(B) are sectional views of the glue applicator of FIG. 5.

As shown in FIG. 6, an air chamber 51 is formed longitudinally between the swing plate 34 and the presser shoe 35 and along the joined surface of the two. Further, correspondingly to the air chamber 51, a continuous channel (air flow path) 60 is formed longitudinally in the lower surface of the presser shoe 35.

The channel 60 and the air chamber 51 are connected together through communication holes (air nozzles) 61 to supply air to the channel 60. The communication holes 61 are formed over an area about half or less of the maximum paper width, that is, over an area capable of being opposed to the single-faced corrugated board 7.

The air chamber 51 is connected to the compressor 42 through the air pressure regulator 53, whereby air of a predetermined pressure is fed to the air chamber 51 and is jetted from the communication holes 61 and channel 60.

In the glue applicator provided with the presser shoe 35 of the above construction, the single-faced corrugated board 7 is allowed to travel between the presser shoe 35 and the glue applicator roll 2, and air of a predetermined pressure is fed to the air chamber 51 by the air pressure regulating means 53. The air thus fed to the air chamber 51 is jetted toward the single-faced corrugated board 7, through the communication holes 61 and channel 60, both formed in the lower surface of the presser shoe 35. As a result, the board 7 is pushed toward the glue applicator roll 2, and there is formed an air layer between the surface of the board 7 and the presser shoe 35, whereby the frictional resistance and wear of the presser shoe can be greatly diminished.

On the other hand, at both end portions of the single-faced corrugated board 7, the air jet released to the atmosphere from the channel 60, unlike the prior art, does not strike directly against the surface of the glue applicator roll 2, but advances in a direction parallel to the surface of the roll 2. Therefore, the glue present on the roll surface is not scattered. That is, there no longer is the fear that scattered glue may be deposited on the presser shoe, causing deterioration in quality of the board or stain of the glue applicator.

In the glue applicator of this embodiment, the air pressure to be fed to the flexible tube 40 is regulated by the air pressure regulating means 53, whereby the pressing force of the presser shoe 35 against the single-faced corrugated board 7 is controlled.

Figures 7A, 7B:
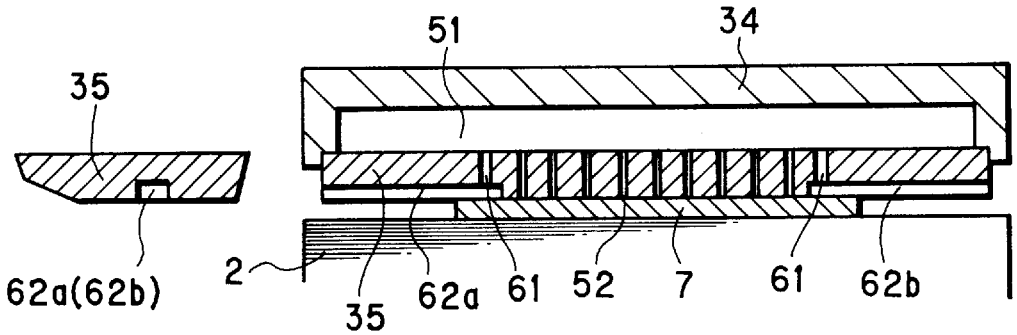
FIGS. 7(A) and 7(B) are sectional views of a presser shoe used in a fourth embodiment of the present invention.

The fourth embodiment of the present invention will be described below with reference to FIG. 7. FIG. 7 is a sectional view of a presser shoe portion.

According to the fourth embodiment, a plurality of air jet holes (air nozzles) 52 are formed in the presser shoe 35, which holes are arranged in the longitudinal direction over the area capable of being opposed to the single-faced corrugated board 7, as referred to in the previous third embodiment. On the other hand, in both longitudinal end portions outside the single-faced corrugated board 7 are formed longitudinally extending partial channels (air flow paths) 62*a* and 62*b*. The channels 62*a* and 62*b* are communicated with the air chamber 51 through communication holes 61. This construction affords the same function and effect as in the third embodiment.

What is claimed is:

1. A glue applicator for a corrugated board, including:

a presser shoe sized to be disposed over an entire width of the corrugated board in an opposed relation to a glue applicator roll with a corrugated board traveling path therebetween;

a flexible tube which presses said presser shoe toward the corrugated board by a fluid pressure;

a controller which regulates said-fluid pressure to be fed to said flexible tube to a predetermined pressure and thereby controls the pressing force of said presser shoe against the corrugated board; and further including a fluid jet arrangement for letting fluid from hold members, said hold members being formed transversely in said presser shoe on a side opposed to the corrugated board;

wherein said presser shoe is formed with a longitudinally extending channel as a fluid flowing path at least on opposite longitudinal end sides thereof located outside the corrugated board traveling path, into which channel the hole members jet fluid.

2. A glue applicator for a corrugated board according to claim 1, wherein said fluid is air.

3. A glue applicator for a corrugated board according to claim 1, wherein no hole member that faces a surface of said glue applicator role is present on said longitudinal end sides.

4. A glue applicator for a corrugated board according to claim 3, wherein said fluid is air.

* * * * *